US007641446B2

(12) United States Patent
Harvey

(10) Patent No.: US 7,641,446 B2
(45) Date of Patent: Jan. 5, 2010

(54) TURBINE BLADE

(75) Inventor: Neil William Harvey, Derby (GB)

(73) Assignee: Rolls-Royce PLC, London (GB)

( * ) Notice: Subject to any disclaimer, the term of this patent is extended or adjusted under 35 U.S.C. 154(b) by 440 days.

(21) Appl. No.: 11/334,401

(22) Filed: Jan. 19, 2006

(65) Prior Publication Data

US 2006/0182633 A1 Aug. 17, 2006

(30) Foreign Application Priority Data

Feb. 16, 2005 (GB) ..... 0503185.1

(51) Int. Cl.
*F01D 5/14* (2006.01)

(52) U.S. Cl. ..... 416/235; 415/173.1

(58) Field of Classification Search ..... 415/173.1, 415/173.5, 173.6; 416/97 R, 92, 235, 236 R, 416/236 A, 237
See application file for complete search history.

(56) References Cited

U.S. PATENT DOCUMENTS 4,585,395 A * 4/1986 Nourse et al. ..... 416/223 A
5,277,549 A * 1/1994 Chen et al. ..... 416/223 A
5,660,523 A * 8/1997 Lee ..... 416/97 R
6,142,739 A * 11/2000 Harvey ..... 416/235
6,709,233 B2 * 3/2004 Haller ..... 415/192
6,779,977 B2 * 8/2004 Lagrange et al. ..... 416/223 A

FOREIGN PATENT DOCUMENTS

GB 2 153 447 A 8/1985
GB 2 162 587 A 2/1986
JP A 10-184305 7/1998

* cited by examiner

*Primary Examiner*—Edward Look
*Assistant Examiner*—Dwayne J White
(74) *Attorney, Agent, or Firm*—Oliff & Berridge, PLC

(57) ABSTRACT

A turbine blade 29 for a gas turbine engine 10 having an axis 20, the turbine blade 29 comprising: an aerofoil 30 including a high pressure surface 36, a low pressure surface 34, a root portion 38 and a tip surface 40 extending transverse from the high and low pressure surfaces 36 and 34, the high and low pressure surfaces 36 and 34 curve from the root portion 38 to the tip surface 40 in a direction that is substantially tangential to the axis 20 of the engine 10; and an air leakage restricting member 32 on the tip surface 40, the air leakage restricting member 32 being configured to substantially prevent leakage of air over the tip surface 40.

20 Claims, 7 Drawing Sheets

TURBINE BLADE

Embodiments of the present invention relate to turbine blades. In particular, they relate to turbine blades for use with gas turbine engines.

A turbine blade is a component of a gas turbine engine. They are usually mounted on and arranged around an annulus which may rotate about an axis of the engine. They are arranged to receive hot gas from at least one combustor of the engine, whereby the flow of hot gas across the turbine blade creates a pressure differential between a high pressure surface and a low pressure surface which causes it to rotate about the axis of the engine. In operation, turbine blades operate at high temperature (above 900° C.) and under high stresses. Consequently, when designing a turbine blade, these factors should be taken into account.

Turbine blades are usually mounted within an annular casing. In order that the turbine blades may rotate freely within the casing, it is necessary to provide a space between a tip surface of the aerofoil and an inner wall of the casing. Due to the pressure difference between the high pressure surface and the low pressure surface, gas may flow over the tip surface of the aerofoil, from the high pressure surface to the low pressure surface, and thereby cause aerodynamic spoiling of the gas flow through the turbine blades and reduce the flow doing useful work in the turbine blades. This may reduce the efficiency of the gas turbine engine.

Therefore, it is desirable to provide an alternative turbine blade.

According to one aspect of the present invention there is provided a turbine blade for a gas turbine engine having an axis, the turbine blade comprising: an aerofoil including a high pressure surface, a low pressure surface, a root portion and a tip surface extending between the high and low pressure surfaces, the high and low pressure surfaces curve from the root portion to the tip surface in a direction that is substantially tangential to the axis of the engine; and an air leakage restricting member on the tip surface, the air leakage restricting member being configured to substantially prevent leakage of air over the tip surface.

The aerofoil may further comprise a leading edge and a trailing edge. At least a portion of the trailing edge may extend from the root portion to the tip surface, preferably solely in a radial direction relative to the axis of the gas turbine engine. The curvature of the high and low pressure surfaces may increase from the root portion to the tip surface.

According to another aspect of the present invention there is provided an air leakage restricting member for coupling to an aerofoil, the aerofoil comprising a high pressure surface, a low pressure surface, a root portion and a tip surface extending between the high and low pressure surfaces, the high and low pressure surfaces curving from the root portion to the tip surface in a direction that is substantially tangential to an axis of a gas turbine engine, wherein the air leakage restricting member is configured to substantially prevent leakage of air over the tip surface.

The air leakage restricting member may comprise a high pressure surface and a low pressure surface which may extend between a leading edge of the air leakage restricting member and a trailing edge of the air leakage restricting member. At least a portion of the high pressure surface may be substantially planar or convex and at least a portion of the low pressure surface may be substantially planar or concave.

The air leakage restricting member may comprise a radially outer surface extending between the high and low pressure surfaces of the air leakage restricting member and may have a surface area greater than a surface area of the tip surface so that the air leakage restricting member overhangs the aerofoil. The radially outer surface may extend transversely between the high and low pressure surface of the air leakage restricting member.

The radially outer surface may have an edge that coincides with an edge of the tip surface, along at least a portion of the high pressure surface of the air leakage restricting member, at the leading edge of the aerofoil.

The air leakage restricting member may have a region of greatest overhang, said region may be along the high pressure surface of the aerofoil at a trailing edge region of the aerofoil.

The air leakage restricting member may comprise a channel extending between a leading edge of the air leakage restricting member and a trailing edge of the air leakage restricting member, for receiving air leaking over the radially outer surface.

In use, the direction of the air exiting the channel may be different to the direction of the air leaving the trailing edge of the aerofoil. The air leakage restricting member may comprise a plurality of conduits for receiving cooling air and may be arranged to provide the cooling air across the surfaces of the air leakage restricting member. The air leakage restricting member may comprise a substantially straight trailing edge. The air leakage restriction member may comprise at least one cavity for reducing the mass of the air leakage restricting member.

According to a further aspect of the present invention there is provided an arrangement of a plurality of turbine blades as claimed in any of the preceding claims for use in a gas turbine engine, wherein the minimum distance between adjacent air leakage restricting members is at a position between a leading edge and a trailing edge of each air leakage restricting member.

An embodiment of the invention will now be described by way of example only with reference to the accompanying drawings in which.

Figure 1:
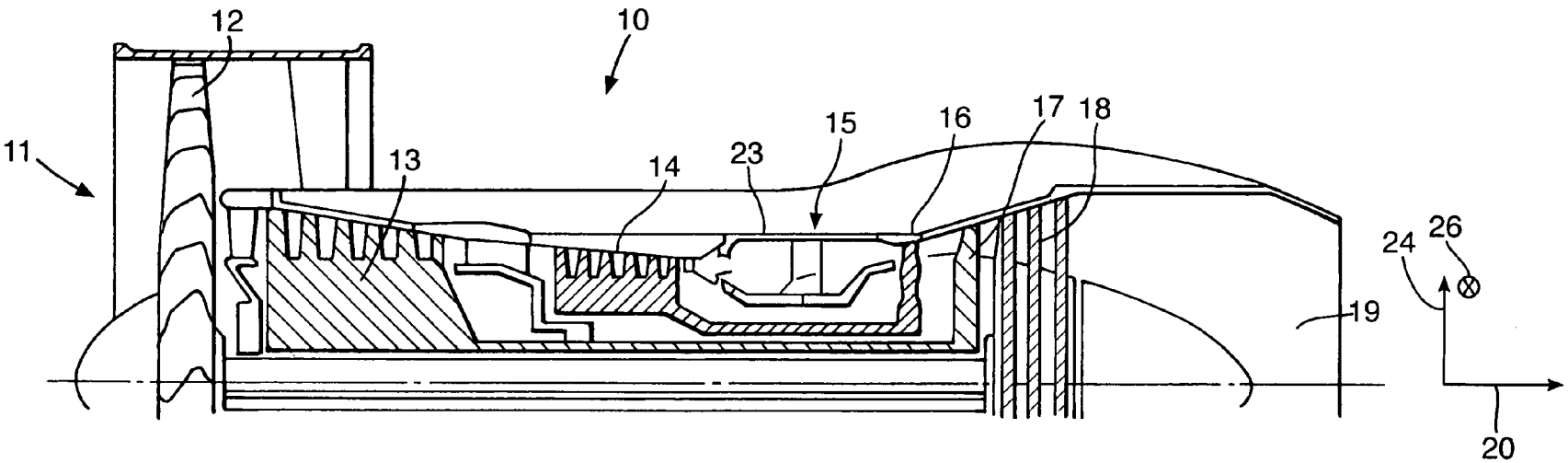
FIG. 1 illustrates a sectional side view of the upper half of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate turbine 17 and a low pressure turbine 18, and an exhaust nozzle 19. The gas turbine engine 10 has an axis 20 that defines an axial direction 22, a radial direction 24 and an azimuthal or tangential direction 26.

The gas turbine engine 10 operates in a conventional manner so that air entering the intake 11 is accelerated by the fan 12 which produces two air flows: a first air flow into the intermediate pressure compressor 13 and a second air flow which provides propulsive thrust. The intermediate pressure compressor 13 compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts.

FIGS. 2 to 7 illustrate a turbine blade 29 for a gas turbine engine 10 having an axis 20, the turbine blade 29 comprising: an aerofoil 30 including a high pressure surface 36, a low pressure surface 34, a root portion 38 and a tip surface 40 extending transverse from the high and low pressure surfaces 36 and 34, the high and low pressure surfaces 36 and 34 curve from the root portion 38 to the tip surface 40 in a direction 26 that is substantially tangential to the axis 20 of the engine 10; and an air leakage restricting member 32 on the tip surface 40, the air leakage restricting member 32 being configured to substantially prevent leakage of air over the tip surface 40.

Figure 2:
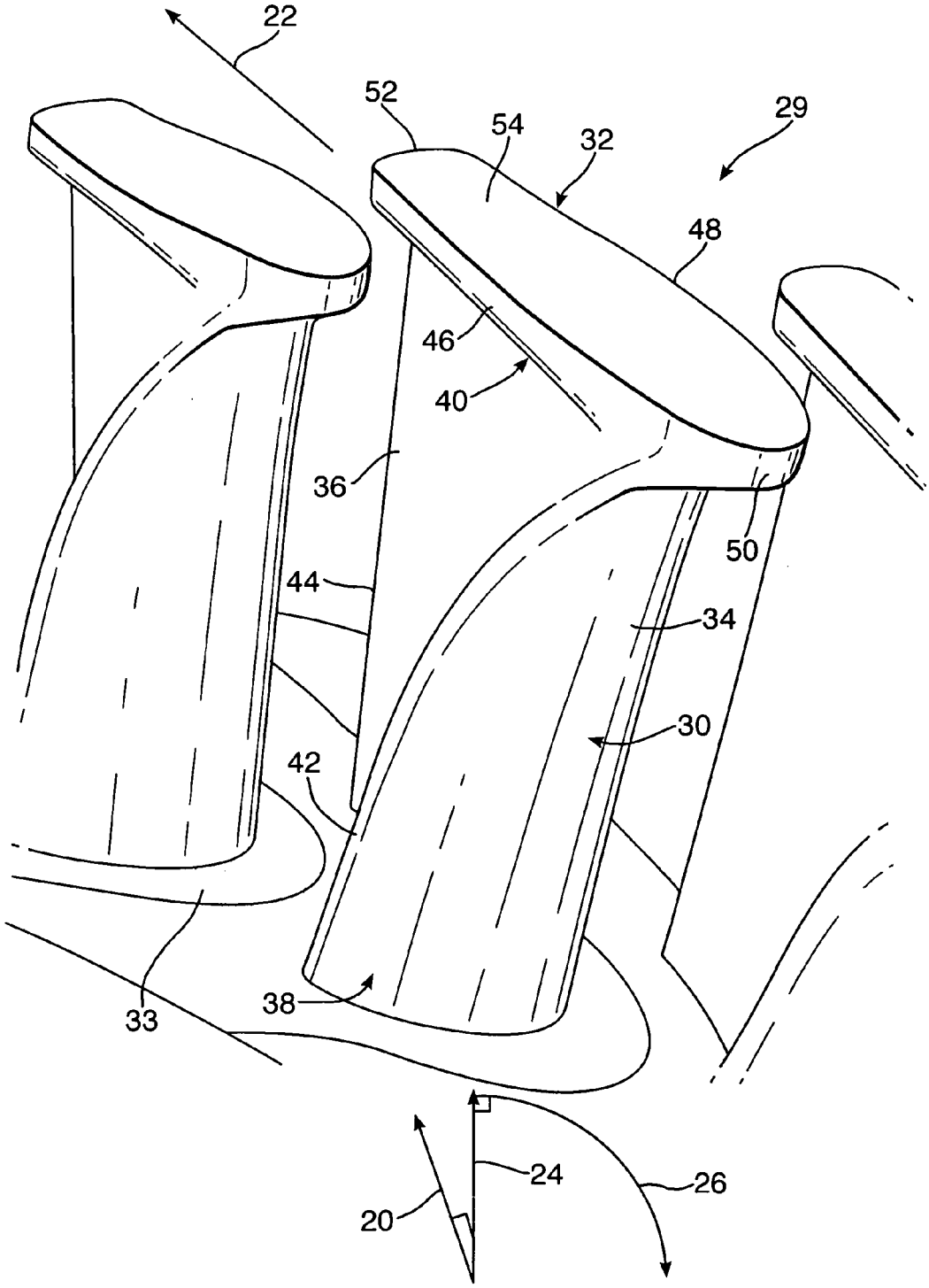
FIG. 2 illustrates a perspective view of a plurality of turbine blades.

FIG. 2 illustrates a perspective view of a plurality of turbine blades 29 including an aerofoil 30 and an air leakage restricting member 32. Each turbine blade 29 is mounted on a disc 33 which extends around the axis 20 of the engine 10. In use, the flow of air exiting the turbines 29 is indicated generally by the arrow 22.

The aerofoil 30 includes a low pressure surface 34 and a high pressure surface 36 which extend radially outwards (in the direction of arrow 24) from a root portion 38. The turbine blade 29 is mounted on the disc 33 at the root portion 38. The aerofoil also includes a tip surface 40 which extends between the high pressure surface 36 and the low pressure surface 34. In one embodiment, the tip surface 40 extends transversely between the high pressure surface 36 and the low pressure surface 34.

Figure 3:
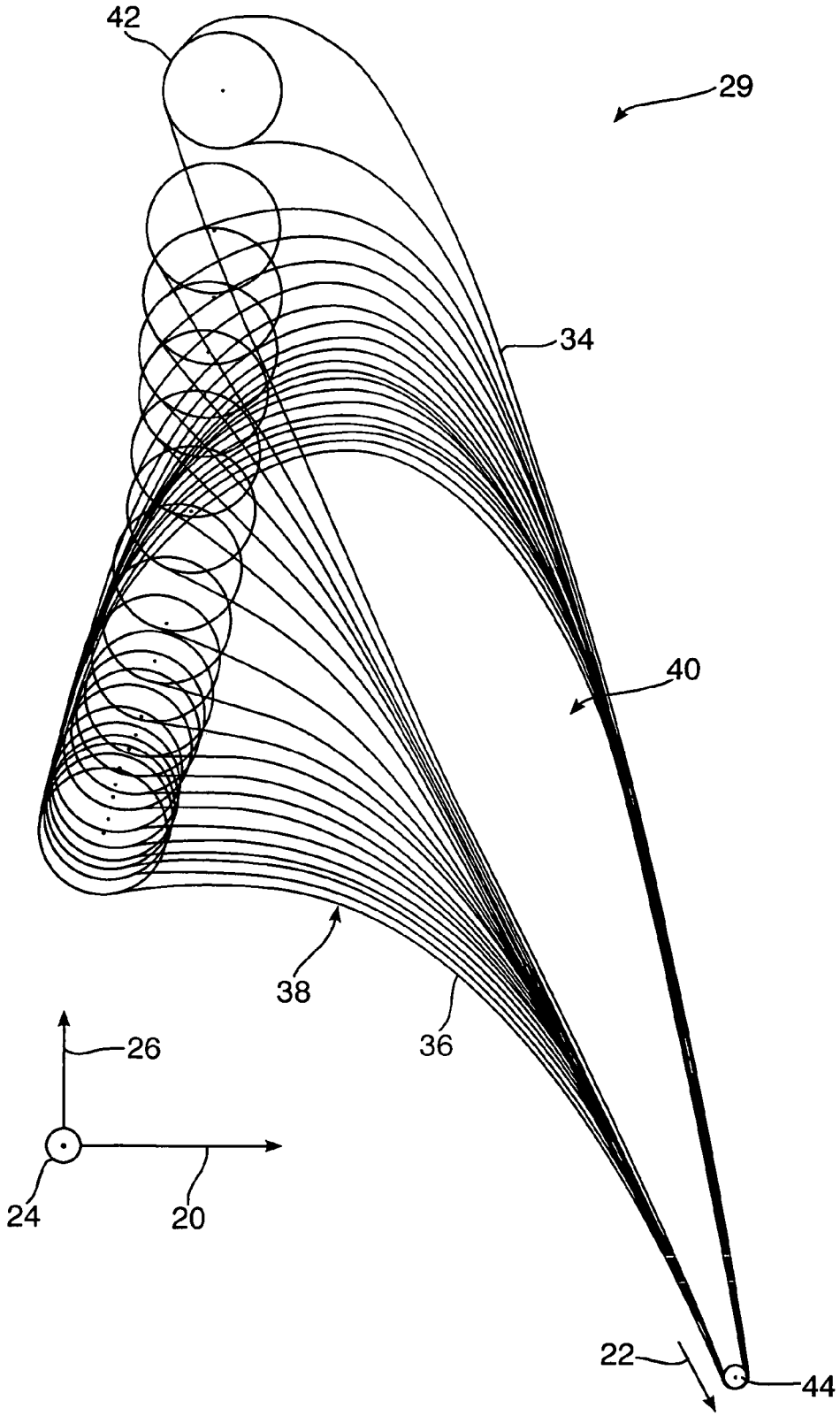
FIG. 3 illustrates a plurality of top down cross sectional views of an aerofoil, each view of the aerofoil corresponding to a different radial position along the aerofoil.

As illustrated in FIGS. 2 and 3, the high and low pressure surfaces 36 and 34 curve from the root portion 38 to the tip surface 40 in a direction that is substantially tangential to the axis of the engine (indicated by arrow 26). As illustrated particularly in FIG. 3, the curvature of the high and low pressure surfaces 36 and 34, increases from the root portion 38 to the tip surface 40.

The air leakage restricting member 32 is mounted on the tip surface 40 of the aerofoil 30. The aerofoil 30 and air leakage restricting member 32 are, in this embodiment, formed together simultaneously. However, in alternative embodiments, they may be formed separately and then connected to one another, for example, by welding. The air leakage restricting member 32 is known in the art as a winglet or a partial shroud.

One advantage provided by the curvature of the aerofoil 30 and by the air leakage restricting member 32 is that they substantially prevent leakage of air over the tip surface 40, from the high pressure surface 36 to the low pressure surface 34. This helps to minimise the aerodynamic spoiling of the gas flow through the turbines 29 and maximise the flow doing useful work in the turbines 29. Consequently, this helps to maximise the efficiency of the gas turbine engine 10.

The aerofoil 30 includes a leading edge 42 and a trailing edge 44. The leading edge 42 is substantial curved from the root portion 38 to the tip surface 40 in a direction that is tangential to the axis of the engine (indicated by the arrow 26). The trailing edge 44 extends from the root portion 38 to the tip surface 40 in a solely radial direction (indicated by arrow 24). These features are clearly shown in FIG. 3 which illustrates a plurality of top down cross sectional views of the aerofoil 30 at different radial positions. The leading edge 42 varies in position for each cross sectional view, whereas the trailing edge 44 does not vary in position for each cross sectional view. One advantage provided in this embodiment by the trailing edge 44 extending in a solely radial direction is that it is simpler to machine cooling holes into the aerofoil 30 in the trailing edge region. This may reduce the cost of the turbine blade 29.

Figure 4:
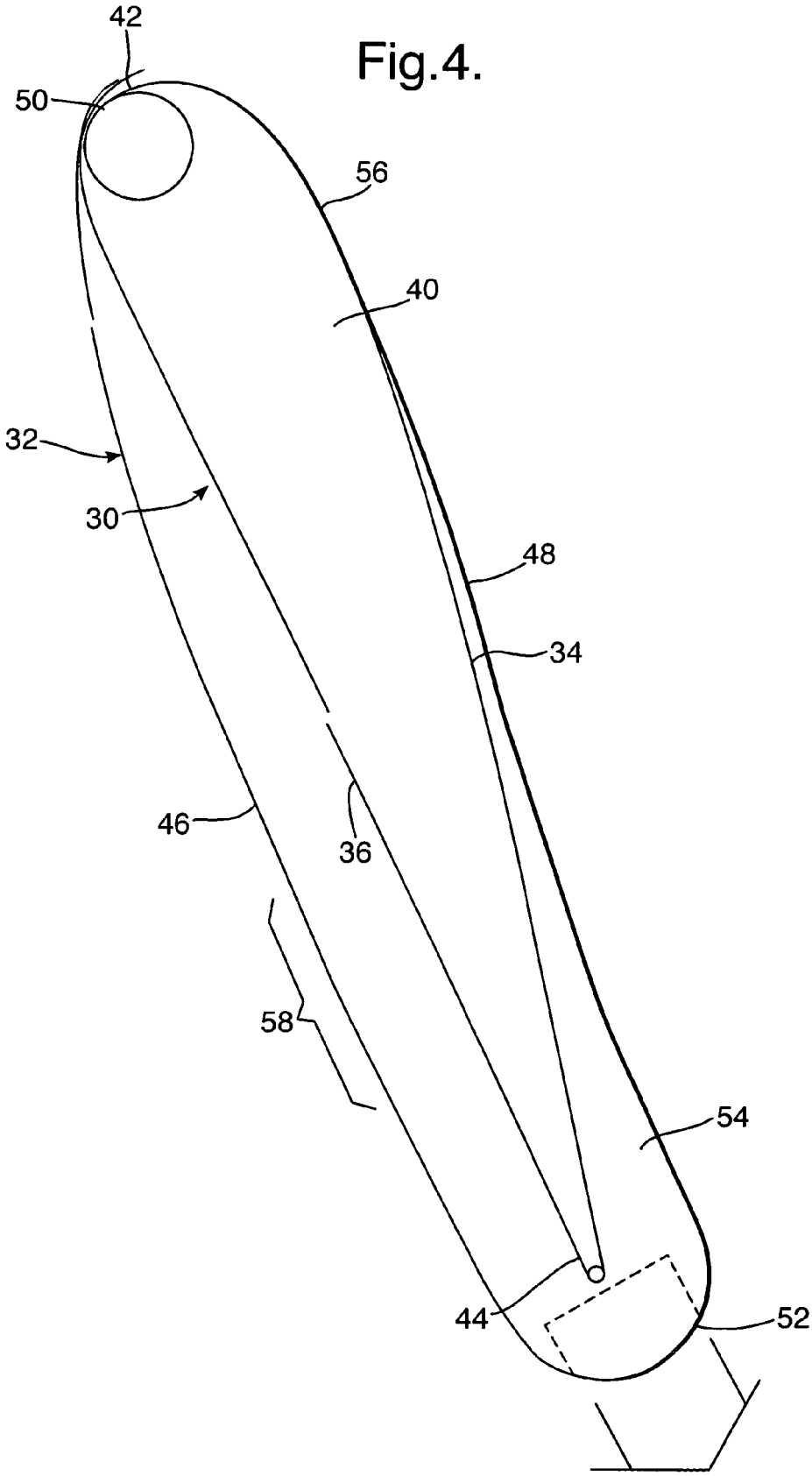
FIG. 4 illustrates a cross sectional top down view of an air leakage restricting member and an aerofoil.

FIG. 4 illustrates a top down cross sectional view of the aerofoil 30 and the air leakage restricting member 32. The air leakage restricting member 32 includes a high pressure surface 46 and a low pressure surface 48 which extend between a leading edge 50 and a trailing edge 52 of the air leakage restricting member 32 (also illustrated in FIG. 2). In this embodiment, at least a portion of the high pressure surface 46 is convex in shape. In an alternative embodiment, the high pressure surface 46 is substantially planar. In this embodiment, at least a portion of the low pressure surface 48 is substantially concave. In an alternative embodiment, the low pressure surface 48 is substantially planar.

The air leakage restricting member 32 also includes a radially outer surface 54 which extends between the high and low pressure surfaces 46 and 48. The surface area of the radially outer surface 54 is greater than the surface area of the tip surface 40. Consequently, the air leakage restricting member 32 overhangs the aerofoil 30. The region of greatest overhang of the air leakage restricting member 32 over the aerofoil 30 is along the high pressure surface 34, at a trailing edge region 58 of the aerofoil 30. The trailing edge region 58 extends from a position adjacent the trailing edge 52 to approximately ⅓ of the length of the air leakage restricting member 32.

The radially outer surface 54 has an edge 56 which coincides with an edge of the tip surface 40. The edge 56 is located along the high pressure surface 48 at the leading edge 50 of the air leakage restricting member 32. The edge 56 extends from the leading edge 50 for approximately ⅓ of the length of the air leakage restricting member 32. In this embodiment, the trailing edge 52 is at least partially curved.

Figure 5:
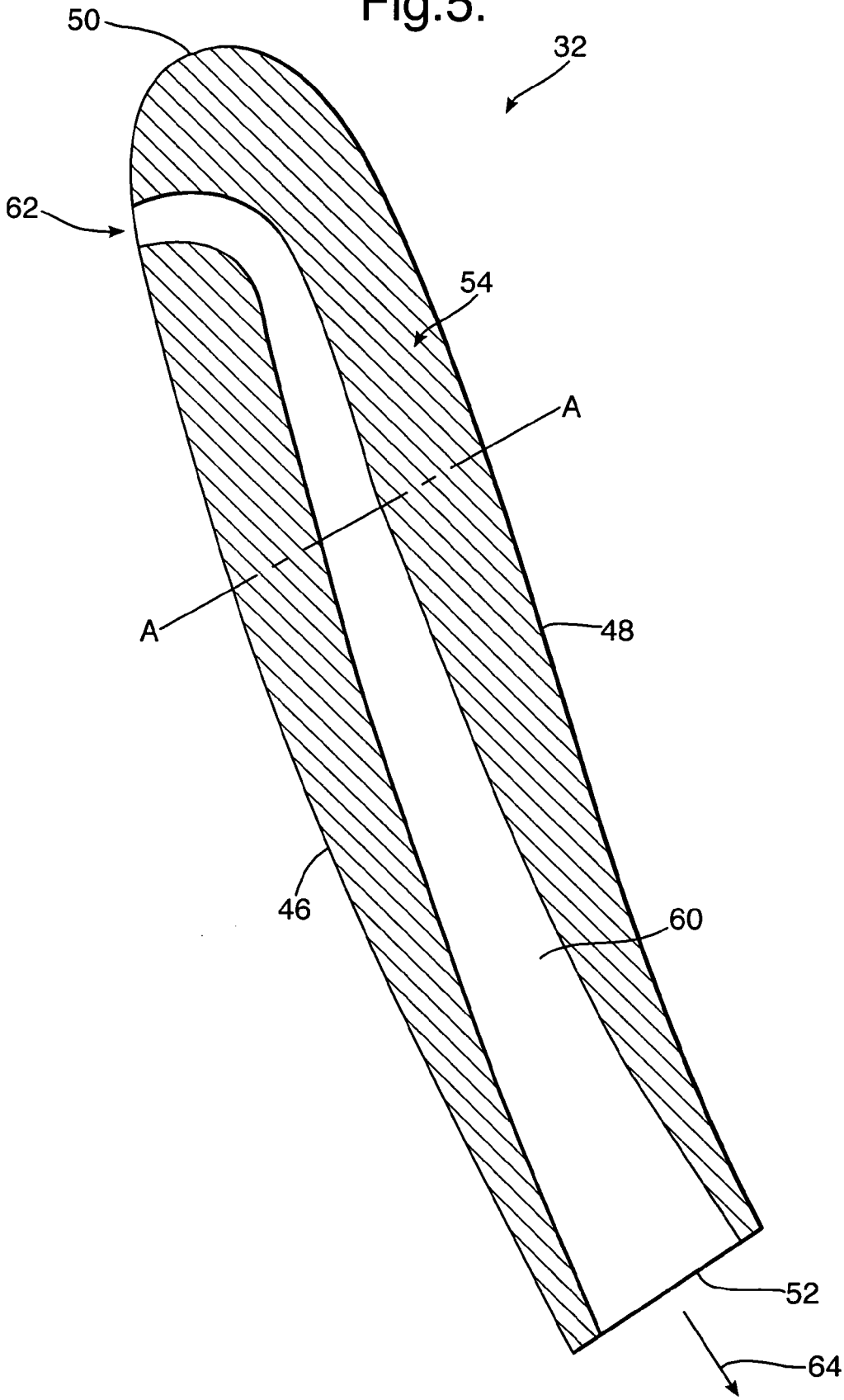
FIG. 5 illustrates a cross sectional top down view of an air leakage restricting member.

FIG. 5 illustrates a top down cross sectional view of the air leakage restricting member 32. The air leakage restricting member 32 includes a channel 60 which extends between an opening 62 (at a stagnation point) at the leading edge 50 and the trailing edge 52. The channel 62 receives air leaking over the radially outer surface 54 and via the opening 62. If air leaks from the high pressure surface 46 to the low pressure surface 48, it is received by the channel 60 and expelled in a direction 64 at the trailing edge 52. An advantage provided by this feature in this embodiment is that the air is prevented, at least partially, from leaking to the low pressure surface 48 and therefore, the aerodynamic spoiling of the gas flow through the turbines 29 is minimised. This may help to maximise the efficiency of the gas turbine engine 10.

In this embodiment, the trailing edge 52 is substantially straight. One advantage provided by a substantially straight trailing edge 52 is that it reduces the mass of the air leakage restricting member 32 and thereby reduces the stresses on the aerofoil 30 when the turbine blade 29 is in use. As mentioned above, turbine blades 29 operate at high temperatures and high stresses may cause creep. By reducing the stresses on the aerofoil 30, the turbine blade 29 may have a longer operational lifetime.

Figure 6:
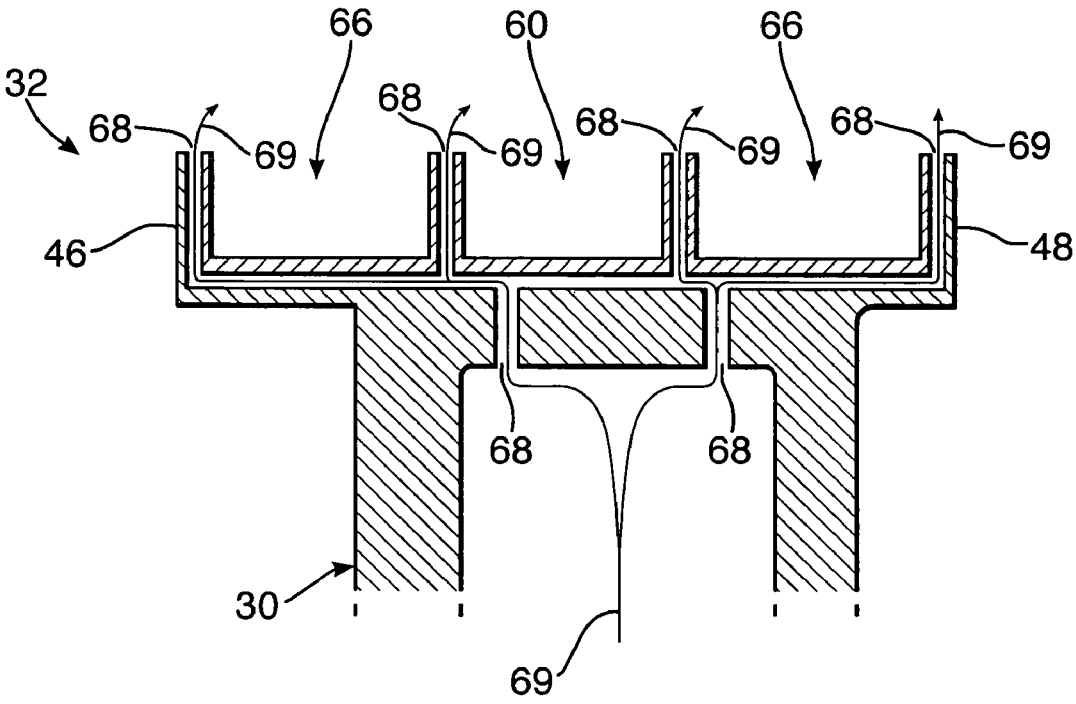
FIG. 6 illustrates a cross sectional front view of an air leakage restricting member and an aerofoil.

FIG. 6 illustrates a front cross sectional view, along the line A-A illustrated in FIG. 5, of the air leakage restricting member 32 and the aerofoil 30. In this embodiment, the air leakage restricting member 32 comprises a plurality of cavities 66 for reducing the mass of the air leakage restricting member 32. One advantage provided by the cavities 66 is that they may reduce the operational stresses on the aerofoil 30 and thereby increase the life time of the turbine blade 29 as mentioned above.

In this embodiment the air leakage restricting member 32 comprises a plurality of conduits 68 for receiving cooling air (usually from the compressors 13 and 14) and for providing the cooling air across the surfaces of the air leakage restricting member 32. The direction of the cooling air is indicated by arrows 69. One advantage provided by cooling the air leakage restricting member 32 is that it may reduce creep when the turbine blade is in operation and thereby increase the operational lifetime of the turbine blade 29.

Figure 7:
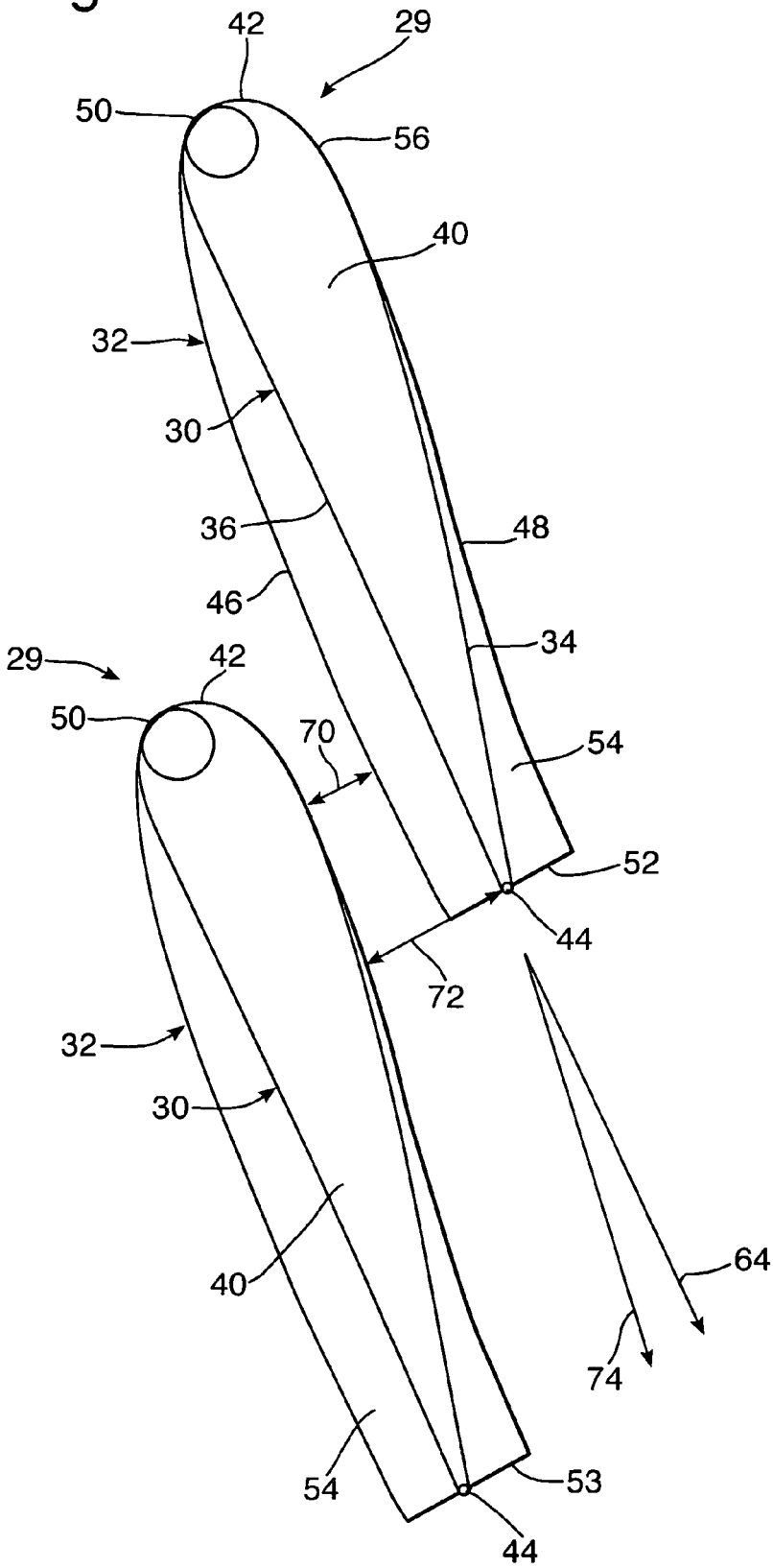
FIG. 7 illustrates a cross sectional top down view of a plurality of air leakage restricting members.

FIG. 7 illustrates a top down cross sectional view of a plurality of turbine blades 29. The minimum distance between adjacent air leakage restricting members 32 is at a position 70 between the leading edge 50 and the trailing edge 52 of each air leakage restricting member 32. In prior art arrangements, the minimum distance between adjacent air leakage restricting members was at the position 72 (at the trailing edge). One advantage provided by this arrangement is that it reduces the mass flow of air in the tip region of the turbine blades 29 and thereby reduces the leakage of air over the radially outer surface 54 of the air leakage restricting members 32.

Furthermore, the direction of air 64 exiting the channel 60 of the air leakage restricting member 32 is different to the direction of air 74 leaving the trailing edge 44 of the aerofoil 30. This is caused, in part, by the convex shape of the high pressure surface 46 and the concave shape of the low pressure surface 48. It may also be caused by the orientation of the channel 60 along the air leakage restricting member 32.

Although embodiments of the present invention have been described in the preceding paragraphs which reference to various examples, it should be appreciated that modifications to the examples given can be made without departing from the scope of the invention as claimed.

Whilst endeavouring in the foregoing specification to draw attention to those features of the invention believed to be of particular importance, it should be understood that the applicant claims protection in respect of any patentable feature or combination of features herein referred to and/or shown in the drawings whether or not particular emphasis has been placed thereon.

I claim:

1. A turbine blade for a gas turbine engine having an axis from an intake of the engine to the exhaust of the engine, the turbine blade extending in a radial direction from the axis, the turbine blade comprising:

an aerofoil including a high-pressure surface, a low pressure surface, a leading edge, a trailing edge, a root portion and a tip surface extending between the high and low pressure surfaces; and an air leakage restricting member on the tip surface, the air leakage restricting member being configured to substantially prevent leakage of air over the tip surface, wherein the leading edge curves from the root portion to the tip surface, in a direction that is substantially tangential to the axis of the engine, and the trailing edge is substantially straight, wherein the curvature of the leading edge increases from the root portion to the tip surface, and wherein the air leakage restricting member comprises a high pressure surface and a low pressure surface, extending between a leading edge of the air leakage restricting member and a trailing edge of the air leakage restricting member, at least a portion of the high pressure surface being one of substantially planar and convex and at least a portion of the low pressure surface being one of substantially planar and concave.

2. A turbine blade as claimed in claim 1, wherein the air leakage restricting member comprises a radially outer surface extending between the high and low pressure surfaces of the air leakage restricting member and having a surface area greater than a surface area of the tip surface so that the air leakage restricting member overhangs the aerofoil.

3. A turbine blade as claimed in claim 2, wherein the radially outer surface has an edge that coincides with an edge of the tip surface, along at least a portion of the high pressure surface of the air leakage restricting member, at the leading edge of the aerofoil.

4. A turbine blade as claimed in claim 2, wherein the air leakage restricting member has a region of greatest overhang, said region being along the high pressure surface of the aerofoil at a trailing edge region of the aerofoil.

5. A turbine blade as claimed in claim 1, wherein the air leakage restricting member comprises a channel extending between a leading edge of the air leakage restricting member and a trailing edge of the air leakage restricting member, for receiving air leaking over the radially outer surface.

6. A turbine blade as claimed in claim 5, wherein, in use, the direction of the air exiting the channel is different to the direction of the air leaving the trailing edge of the aerofoil.

7. A turbine blade as claimed in claim 1, wherein the air leakage restricting member comprises a plurality of conduits for receiving cooling air and arranged to provide the cooling air across the surfaces of the air leakage restricting member.

8. A turbine blade as claimed in claim 1, wherein the air leakage restricting member comprises a substantially straight trailing edge.

9. A turbine blade as claimed in claim 1, wherein the air leakage restriction member comprises at least one cavity for reducing the mass of the air leakage restricting member.

10. An arrangement of a plurality of turbine blades as claimed in claim 1 for use in a gas turbine engine, wherein the minimum distance between adjacent air leakage restricting members is at a position between a leading edge and a trailing edge of each air leakage restricting member.

11. An air leakage restricting member for coupling to an aerofoil, the aerofoil comprising a high pressure surface, a low pressure surface, a leading edge, a trailing edge, a root portion and a tip surface extending between the high and low pressure surfaces, the leading edge curving from the root portion to the tip surface in a direction that is substantially tangential to an axis of a gas turbine engine and the trailing edge being substantially straight, wherein the air leakage restricting member is configured to substantially prevent leakage of air over the tip surface, and wherein the curvature of the leading edge increases from the root portion to the tip surface.

12. An air leakage restricting member as claimed in claim 11, comprising a high pressure surface and a low pressure surface, extending between a leading edge of the air leakage restricting member and a trailing edge of the air leakage restricting member, at least a portion of the high pressure surface being one of substantially planar and convex and at least a portion of the low pressure surface being one of substantially planar and concave.

13. An air leakage restricting member as claimed in claim 12, comprising a radially outer surface extending between the high and low pressure surfaces and having a surface area greater than a surface area of the tip surface so that the air leakage restricting member overhangs the aerofoil.

14. An air leakage restricting member as claimed in claim 13, wherein the radially outer surface has an edge that coincides with an edge of the tip surface, along at least a portion of the high pressure surface of the air leakage restricting member, at a leading edge of the aerofoil.

15. An air leakage restricting member as claimed in claim 11, wherein the air leakage restricting member has a region of greatest overhang, said region being along the high pressure surface of the aerofoil at a trailing edge region of the aerofoil.

16. An air leakage restricting member as claimed in claim 11, comprising a channel extending between a leading edge of the air leakage restricting member and a trailing edge of the air leakage restricting member, for receiving air leaking over the radially outer surface.

17. An air leakage restricting member as claimed in claim 16, wherein, in use, the direction of air exiting the channel is different to the direction of air leaving the trailing edge of the aerofoil.

18. An air leakage restricting member as claimed in claim 11, comprising a plurality of conduits for receiving cooling air and arranged to provide the cooling air across the surfaces of the air leakage restricting member.

19. An air leakage restricting member as claimed in claim 11, comprising a substantially straight trailing edge.

20. An air leakage restricting member as claimed in claim 11, comprising at least one cavity for reducing the mass of the air leakage restricting member.

* * * * *